US006091284A

United States Patent [19]

Mizu

[11] Patent Number: 6,091,284

[45] **Date of Patent: *Jul. 18, 2000**

[54] CURRENT CONTROL CIRCUIT

[75] Inventor: Yasuyuki Mizu, Ishikawa-ken, Japan

[73] Assignee: Murata Manufacturing Co., Ltd., Nagaokakyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,936

[22] Filed: Dec. 22, 1997

[51] Int. Cl.[7] ..... G05F 3/02

[52] U.S. Cl. ..... 327/538; 307/60

[58] Field of Search ..... 307/52, 60; 323/312; 327/530, 531, 532, 538, 547, 87

[56] References Cited

U.S. PATENT DOCUMENTS

| | | | |
|---|---|---|---|
| 4,008,418 | 2/1977 | Murphy | 361/18 |
| 5,079,497 | 1/1992 | Barbu et al. | 323/281 |
| 5,442,277 | 8/1995 | Mori et al. | 323/312 |
| 5,578,960 | 11/1996 | Matsumura et al. | 327/540 |
| 5,808,458 | 9/1998 | Fujisawa et al. | 323/312 |
| 5,861,771 | 1/1999 | Matsuda et al. | 327/540 |

*Primary Examiner*—Jung Ho Kim
*Attorney, Agent, or Firm*—Burns, Doane, Swecker & Mathis, LLP

[57] ABSTRACT

A current control circuit is provided which is capable of maintaining a constant DC current flowing in a load resistor irrespective of the resistance value of a load resistor connected to a connection terminal. To this end, a constant current circuit (21) is connected to a RING terminal (2), which acts as the connection terminal. The constant current circuit (21) controls a current drive circuit (6) in response to a voltage at the RING terminal (2) to ensure that a DC current flowing in a power feed resistor (4) is kept constant. Due to the fact that DC current flowing in the load resistor irrespective of the resistance value of the load resistor is kept constant, the burden placed on a power supply of a subscriber line interface in a telecommunications network is no longer increased. Also, there no longer arises a need for increasing a power feed resistance and the rating of a power feed transistor, which, in turn, leads to a reduction in manufacturing cost.

6 Claims, 2 Drawing Sheets

CURRENT CONTROL CIRCUIT

The present specification is based on Japanese Patent Document No. 8-347896, which is incorporated herein in its entirety by reference.

BACKGROUND OF THE INVENTION

1. Field of the Invention

The present invention relates to current control circuits for use with subscriber line interfaces in communications systems, and more particularly to current control circuits capable of maintaining a constant DC current flowing in a load irrespective of the magnitude of the load.

2. Description of the Prior Art

FIG. 2 shows an example of a prior known current control circuit for use with subscriber line interfaces in a telecommunications network. In FIG. 2, the current control circuit 1 is constructed from a RING terminal 2 acting as a connection terminal, a TIP terminal 3, a power feed resistor 4, a power supply terminal 5, a current drive circuit 6, a reference voltage input terminal 7, a resistor 8, a capacitor 9, and an AC signal input terminal 10. The current drive circuit 6 essentially consists of a power feed transistor 11 of PNP conductivity type, operational amplifier 12, and feedback resistor 13. Note that reference numeral 14 designates an associative load resistor, which may correspond to the internal resistance of a telephone as connected to the current control circuit 1.

Here, the RING terminal 2 is connected through the power feed resistor 4 to the emitter of the power feed transistor 11 constituting the current drive circuit 6 and also to the feedback resistor 13. The collector of power feed transistor 11 is connected to the power supply terminal 5. The base of the power feed transistor is connected to an output terminal of the operational amplifier 12. The feedback resistor 13 is connected to an inverting input terminal of the operational amplifier 12 and is also connected to the AC signal input terminal 10 via a series combination of the resistor 8 and capacitor 9. Further, a non-inverting input terminal of the operational amplifier 12 is connected to the reference voltage input terminal 7. Furthermore, the load resistor 14 is connected between the RING terminal 2 and TIP terminal 3. The circuit connected to the TIP terminal 3 is not directly pertinent to the invention described herein, and therefore a detailed discussion of this circuit is omitted.

In the current control circuit 1 thus configured, a DC current is input from the TIP terminal 3 and flows into the power supply terminal 5 through the load resistor 14, RING terminal 2, power feed resistor 4, and power feed transistor 11. The operational amplifier 12 operates to drive the power feed transistor 11 in such a way as to force a voltage at the emitter of the power feed transistor 11 to be equal to a voltage input from the reference voltage input terminal 7 to the non-inverting input terminal of operational amplifier 12, thereby allowing such DC current to flow into the power feed transistor 11.

On the other hand, an AC signal such as an audio signal flows from the AC signal input terminal 10 into the TIP terminal 3 via the capacitor 9, resistor 8, feedback resistor 13, power feed resistor 4, RING terminal 2 and load resistor 14.

However, in the above example, the DC current flowing in the load resistor 14 varies with a change in resistance value of the load resistor 14. Especially, in the state in which the load resistor 14 is low in resistance value, DC current flowing in load resistor 14 increases causing an increase in the burden imposed on the power supply of current control circuit 1. A problem thus arises in that the current capacity of the power supply is required to be increased in advance in order to accommodate such a circumstance. Another problem is that the power supply's allowable electric power is also required to be increased in advance by taking account of the fact that large DC current might similarly flow in the power feed resistor 4 and power feed transistor 11, which would increase the cost of the current control circuit.

SUMMARY OF THE INVENTION

It is an object of the present invention to avoid the above-described problems, thus providing a current control circuit capable of eliminating a variation of DC current flowing in a load resistor even upon the occurrence of a change in load resistance.

To attain the foregoing object, the present invention provides a current control circuit having a connection terminal for providing connection to a load resistor. A power supply terminal supplies a current to the load resistor. A power feed resistor is connected to the connection terminal. A current drive circuit is provided between the power supply terminal and the power feed resistor. A constant current circuit is connected to the connection terminal. The constant current circuit forces a DC current flowing in the power feed resistor to remain constant by controlling the current drive circuit in response to a voltage at the connection terminal.

In accordance with one exemplary aspect of the invention, the constant current circuit includes first and second resistors connected in series between the connection terminal and the power supply terminal, an operational amplifier, and third and fourth resistors connected in series between an output terminal of the operational amplifier and ground. A connection node between the first and second resistors is connected to a non-inverting input terminal of the operational amplifier. A connection node between the third and fourth resistors is connected to an inverting input terminal of the operational amplifier. An output of the operational amplifier is connected to the current drive circuit.

It is possible by constructing the current control circuit in the manner described above to force a DC current flowing in the load resistor, power feed resistor and current drive circuit to a constant value irrespective of the resistance value of such load resistor.

BRIEF DESCRIPTION OF THE DRAWINGS

The foregoing and other, objects, features and advantages of the present invention will be more readily understood upon reading the following detailed description in conjunction with the drawings in which.

DETAILED DESCRIPTION OF THE INVENTION

Figure 1:
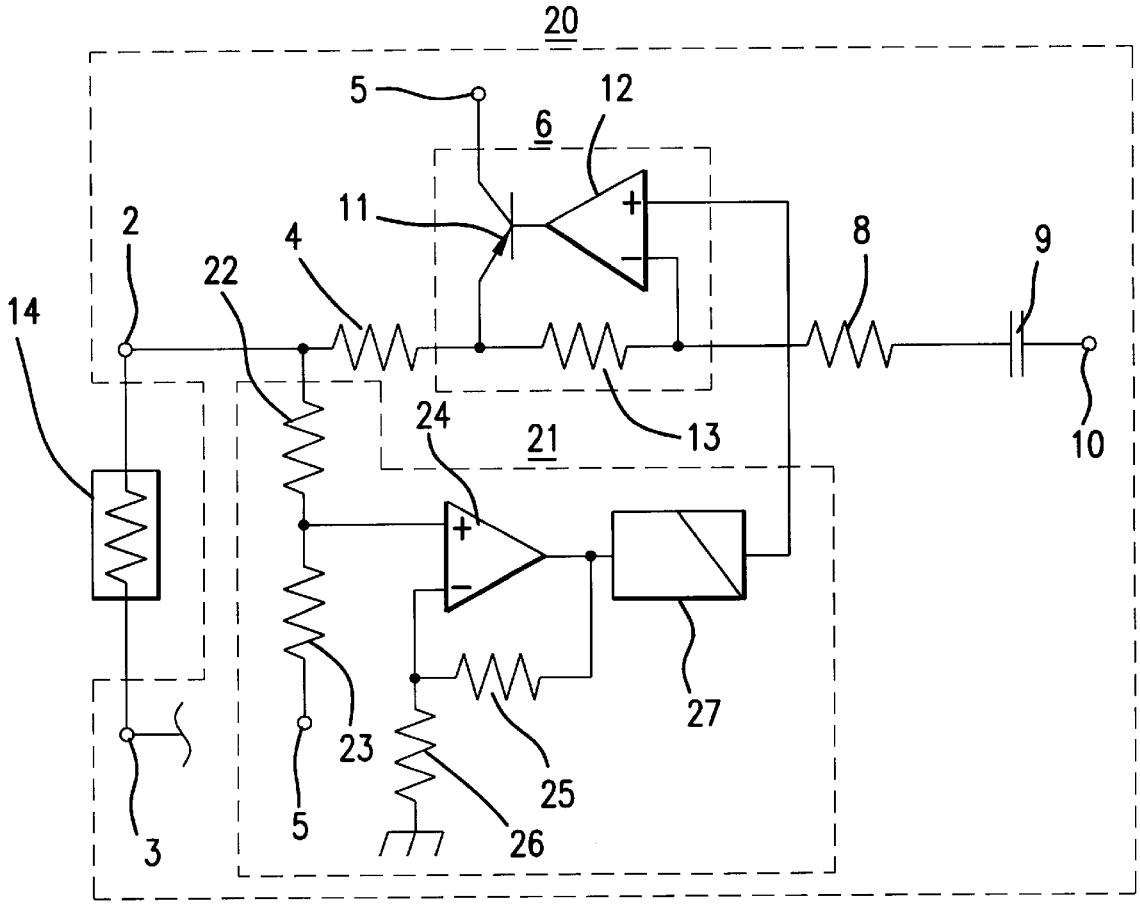
FIG. 1 is a circuit diagram showing one exemplary embodiment of a current control circuit in accordance with the invention.
Figure 2:
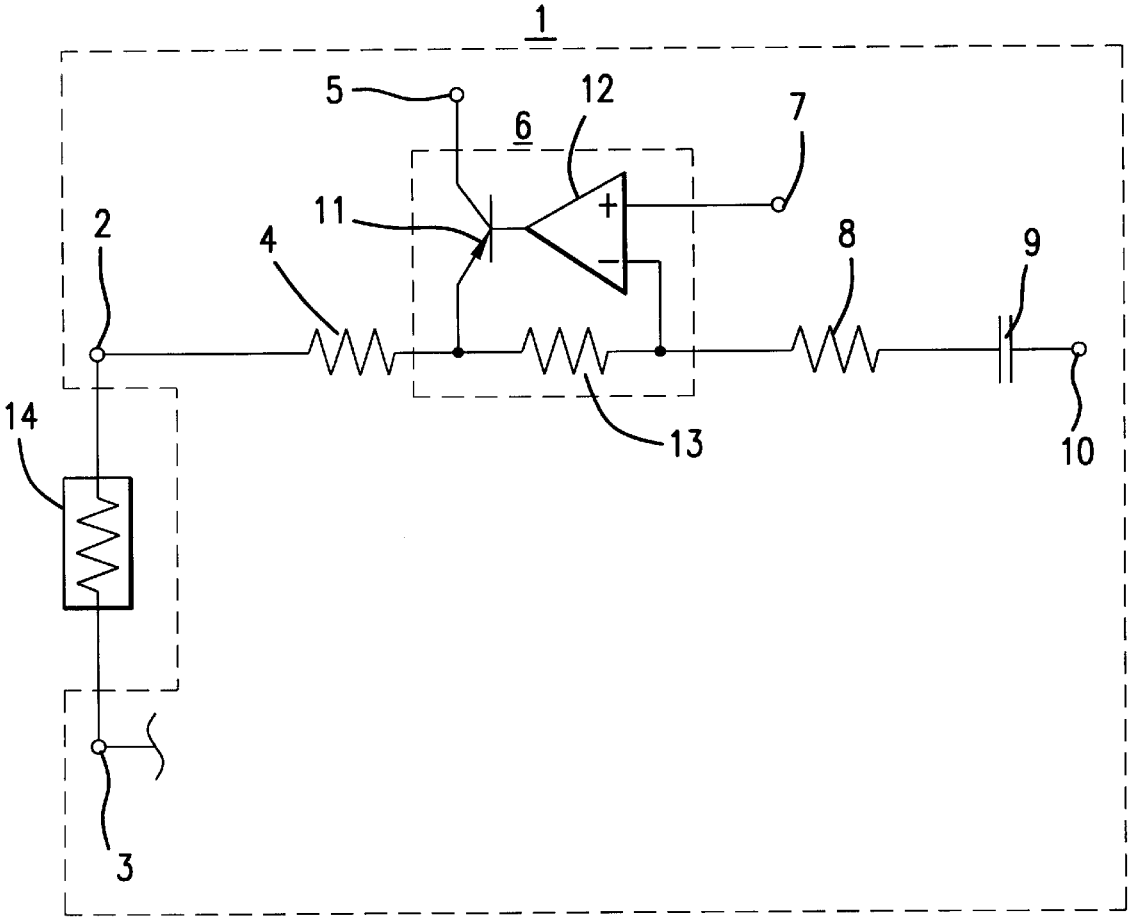
FIG.2 PRIOR ART
FIG. 2 is a circuit diagram showing one prior art current control circuit.

FIG. 1 shows one preferred embodiment of the current control circuit of the invention for use with a subscriber line interface in a communications network. In FIG. 1, parts or components similar to those of FIG. 2 are associated with similar reference numbers, and explanation thereof will be omitted herein.

In FIG. 1, a current control circuit 20 includes a constant current circuit 21 which is connected to a RING terminal 2 functioning as a connection terminal and which has its output connected to a non-inverting input terminal of an operational amplifier 12 included in a current drive circuit 6.

The constant current circuit 21 comprises a first resistor 22, second resistor 23, operational amplifier 24, third resistor 25, fourth resistor 26, and low-pass filter 27. The first resistor 22 and second resistor 23 are connected in series between the RING terminal 2 and power supply terminal 5. A connection node between the resistors 22 and 23 is, in turn, connected to a non-inverting input terminal of the operational amplifier 24. The third resistor 25 and fourth resistor 26 are connected in series between an output terminal of operational amplifier 24 and ground. A connection node between the resistors 25 and 26 is connected to an inverting input terminal of operational amplifier 24. An output terminal of operational amplifier 24 is connected through the low-pass filter 27 to the non-inverting input terminal of the operational amplifier 12 included in the current drive circuit 6.

An explanation will now be given of the operation of the current control circuit 20. First of all, "IL" denotes a DC current which is input from the TIP terminal 3 serving as a second terminal which flows into the power supply terminal 5 via the load resistor 14, RING terminal 2, power feed resistor 4 and power feed transistor 11. Further, "Vr" denotes a voltage at RING terminal 2, "Vb" denotes a voltage at power supply terminal 5, and "r" denotes a resistance value of power feed resistor 4. "R1" and "a×R1" denote values of the first resistor 22 and second resistor 23, respectively (where "a" is a coefficient). "Vin" denotes a voltage at the non-inverting input terminal of the operational amplifier 24. "Vout" denotes a voltage of the output terminal of operational amplifier 24. Resistance values of the third resistor 25 and fourth resistor 26 are denoted by "R2" and "a×R2", respectively. A voltage at the emitter of the power feed transistor 11 is denoted by "Ve."

Since an input impedance of the non-inverting input terminal of the operational amplifier 24 is sufficiently high with respect to the resistance values of the first and second resistors, Vin becomes equal to a value of Vr and Vb divided by two resistors, and thus may be expressed by:

$$\mathrm{Vin}=(a\times \mathrm{Vr}+\mathrm{Vb})/(1+a) \quad (1).$$

Further, the operational amplifier 24 and third resistor 25 as well as fourth resistor 26 form one typical non-inversion amplifier circuit. Hence, the voltage Vout at the output terminal of operational amplifier 24 may be given as:

$$\mathrm{Vout}=(1+1/a)\mathrm{Vin} \quad (2).$$

Substituting Equation (1) into Eq. (2), we obtain:

$$\mathrm{Vout}=\mathrm{Vr}+\mathrm{Vb}/a \quad (3).$$

Here, Vout is expressed in terms of Vr. Since the RING terminal 2 is inherently located along a route of an AC signal, Vr is superimposed with such AC signal. Vout, which is a function of Vr, is also superimposed with the AC signal. Then, the AC signal is removed from Vout at the low-pass filter 27 causing the resultant signal to be input to the non-inverting input terminal of operational amplifier 12 included in the current drive circuit 6.

The current drive circuit 6 is also a non-inversion amplifier circuit, which operates by forcing voltages at two input terminals of the operational amplifier 12 to be identical to each other. Accordingly, a voltage at the non-inverting input terminal of operational amplifier 12 also becomes identical to Vout. However, DC current does not flow into the feedback resistor 13 because of the fact that the non-inverting input terminal of operational amplifier 12 remains sufficiently high in impedance. For this reason, the voltage Ve at the emitter terminal of power feed transistor 11 becomes equivalent to Vout, which is represented by:

$$\mathrm{Ve}=\mathrm{Vout}=\mathrm{Vr}+\mathrm{Vb}/a \quad (4).$$

The DC current IL flowing in power feed resistor 4 may be expressed using the resistance value r of power feed resistor 4 and a difference between the voltages Vr and Ve at both ends of power feed resistor 4 as follows:

$$\mathrm{IL}=(\mathrm{Vr}-\mathrm{Ve})/r \quad (5).$$

Substituting Eq. (4) into equation (5), we obtain:

$$\mathrm{IL}=(\mathrm{Vr}-(\mathrm{Vr}+\mathrm{Vb}/a))/r=-\mathrm{Vb}/(a\times r) \quad (6)$$

In Eq. (6), Vb, a and r are all fixed values. Therefore, it can be readily seen that, in this circuit, the DC current IL flowing in the load remains constant irrespective of the resistance value of load resistor 14.

It thus becomes possible by controlling the current drive circuit 6 in responding to a voltage of the RING terminal 2 in the above-discussed manner to constantly hold or retain DC current regardless of the resistance value of load resistor 14, which current flows in the load resistor 14, power feed resistor 4 and power feed transistor 11. This results in reducing the burden imposed on the power supply of the subscriber line interfaces in communication links while simultaneously avoiding the necessity of excessively increasing the rating of power feed resistor 4 and that of power feed transistor 11. This has the effect of reducing manufacturing costs.

It should be noted that, in the foregoing embodiment, an explanation was given under an assumption that the current control circuit is for use with a subscriber line interface in communications networks. However, the principles of the invention can also be applied to other circuits insofar as these circuits are adaptable for use in providing a constant current regardless of the resistance value of a load to be coupled thereto.

In accordance with the current control circuit of this invention, it is possible by controlling the current drive circuit in response to a voltage of the RING terminal acting as a connection terminal to force a DC current flowing in a load resistor, power feed resistor and power feed transistor to be kept constant irrespective of the resistance value of such load resistor. This results in the elimination of an undesired increase in burden imposed on the power supply of subscriber line interfaces in a communications network while avoiding the need to excessively increase ratings of the power feed resistor and power feed transistor. This has the effect of reducing manufacturing cost.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A current control circuit comprising:

a connection terminal for providing connection to a load resistor;

a power supply terminal for use in supplying a current to said load resistor;

a power feed resistor connected to said connection terminal;

a current drive circuit provided between said power supply terminal and said power feed resistor; and a constant current circuit connected to said connection terminal and connected to said power feed resistor, wherein said constant current circuit forces a DC current flowing in said power feed resistor to remain constant by controlling said current drive circuit in response to a voltage at said connection terminal;

wherein said DC current remains constant for various values of resistance of said load resistor.

2. The current control circuit as recited in claim 1, wherein said constant current circuit includes:

first and second resistors connected in series between said connection terminal and said power supply terminal, one end of said first resistor being connected to one end of said second resistor, another end of said first resistor being connected to said connection terminal, and another end of said second resistor being connected to said power supply terminal;

a constant current circuit operational amplifier; and third and fourth resistors connected in series between and output terminal of said operational amplifier and ground, one end of said third resistor being connected to one end of said fourth resistor, another end of said third resister being connected to said out terminal of said operational amplifier, and another end of said fourth resister being connected to said ground.

3. The current control circuit as recited in claim 2, wherein:

a connection node between said first and second resistors is connected to a non-inverting input terminal of said operational amplifier;

a connection node between said third and fourth resistors is connected to an inverting input terminal of said operational amplifier; and an output of said operational amplifier is connected to said current drive circuit.

4. The current control circuit as recited in claim 3, wherein said output of said operational amplifier is connected to said current drive circuit via a low pass filter.

5. The current control circuit as recited in claim 1, wherein said current drive circuit comprises:

a power feed transistor;

a feedback resistor; and a current drive circuit operational amplifier;

wherein an emitter of said power feed transistor is connected between said feedback resistor and said power feed resistor;

wherein a collector of said power feed transistor is connected to said power supply terminal;

wherein a base of said power feed transistor is connected to an output terminal of said current drive circuit operational amplifier;

wherein said feedback resistor is connected to an inverting input terminal of said current drive circuit operational amplifier, and also connected to an AC signal input terminal; and wherein a non-inverting input terminal of the current drive circuit operational amplifier is connected to an output of said constant current circuit.

6. The current control circuit as recited in claim 5, wherein said feedback resistor is connected to said AC signal input terminal via a series-connected resistor and capacitor.

* * * * *